US007753640B2

(12) United States Patent
Miyazaki

(10) Patent No.: US 7,753,640 B2
(45) Date of Patent: Jul. 13, 2010

(54) BOOM FOOT PIN ATTACHMENT AND DETACHMENT APPARATUS FOR CONSTRUCTION MACHINE

(75) Inventor: Kazuyuki Miyazaki, Akashi (JP)

(73) Assignee: Kobelco Cranes Co., Ltd., Tokyo (JP)

( * ) Notice: Subject to any disclaimer, the term of this patent is extended or adjusted under 35 U.S.C. 154(b) by 267 days.

(21) Appl. No.: 11/860,030

(22) Filed: Sep. 24, 2007

(65) Prior Publication Data

US 2008/0093321 A1 Apr. 24, 2008

(30) Foreign Application Priority Data

Oct. 23, 2006 (JP) ..... 2006-287058

(51) Int. Cl.
*B66C 13/00* (2006.01)

(52) U.S. Cl. ..... 414/686; 414/680; 212/177; 52/632

(58) Field of Classification Search ..... 414/686, 414/680; 212/177, 255, 348; 52/123.1, 632
See application file for complete search history.

(56) References Cited

U.S. PATENT DOCUMENTS 3,954,193 A * 5/1976 Whittingham ..... 414/343
3,987,594 A 10/1976 Rao et al.

FOREIGN PATENT DOCUMENTS

| | | |
|---|---|---|
| EP | 1 308 413 A1 | 5/2003 |
| JP | 2000-211888 | 8/2000 |
| JP | 2002-226174 | 8/2002 |

* cited by examiner

*Primary Examiner*—Donald Underwood
(74) *Attorney, Agent, or Firm*—Oblon, Spivak, McClelland, Maier & Neustadt, L.L.P.

(57) ABSTRACT

A bifurcated connection portion is formed on one of an upper rotating body and a boom foot, a flat plate connection portion inserted into the bifurcated connection portion is formed on the other, and pin holes are provided in both the connection portions. A boom foot pin attachment and detachment apparatus is to insert a boom foot pin into both the pin holes aligned, and provided with a cylinder bracket attached to an inner piece of the bifurcated connection portion enabling the boom foot pin to move between an insertion position inside the pin holes and a pull out position outside the pin holes, a slide plate slidably provided on the cylinder bracket, a hydraulic cylinder attached to the plate with a piston rod thereof connected to the boom foot pin, and a regulation plate for selectively regulating sliding of the slide plate or movement of the boom foot pin at a predetermined time.

6 Claims, 15 Drawing Sheets

BOOM FOOT PIN ATTACHMENT AND DETACHMENT APPARATUS FOR CONSTRUCTION MACHINE

BACKGROUND OF THE INVENTION

1. Field of the Invention

The present invention relates to a boom foot pin attachment and detachment apparatus installed in a construction machine.

2. Description of the Related Art

In general, in a construction machine such as a crawler crane, there is a known configuration that when a base end part of a boom, that is a boom foot is attached to an upper rotating body, a bifurcated connection portion is formed on left and right two positions on one of the upper rotating body and the boom foot, and a connection portion inserted into the above connection portion is formed similarly on left and right two positions on the other, and the boom foot is detachably connected to the upper rotating body in a state that both pin holes provided in both the connection portions are aligned. Particularly, in a large sized machine, since a boom foot pin is large and heavy, a foot pin attachment and detachment apparatus for automatically performing insertion and pull out of the foot pin is installed.

As the above apparatus, for example as disclosed in Japanese Patent Laid-Open No. 2002-226174, there is a known configuration that a base end flange is attached to an inner piece of the bifurcated connection portion by bolts, including a cylinder bracket in a substantially cylindrical shape enabling the boom foot pin to move between an insertion position where the boom foot pin is inserted into the pin holes and a pull out position where the boom foot pin is pulled out from the pin holes, and a hydraulic cylinder in which a cylinder main body thereof is attached to a surface (inner surface) of a circular body fixed to a front end of the bracket by bolts and a piston rod thereof is connected to the boom foot pin. For example as disclosed in Japanese Patent Laid-Open No. 2000-211888, the above apparatus is provided as a pair on the left and on the right, and hydraulic cylinders of left and right apparatuses come close in the vicinity of a center line of the upper rotating body.

Meanwhile, in the large sized machine, due to a problem of space on the upper rotating body side, when a plurality of winches are installed to the boom, a number of hose pipes are arranged from the front side of the upper rotating body to a drive motor of the winches on the boom side in order to move the winches. Since the pipes are required to be removed at the time of detaching the boom, the pipes are arranged by using a quick coupler and there is a need for performing connection and removal works of the pipes at the time of assembling and disassembling the boom.

However, since the connection and removal works of the pipes are performed on the front side of the upper rotating body in which the above mentioned apparatus is installed, there is a problem that the apparatus is disturbing the works and hence it is not easy to perform the works.

SUMMARY OF THE INVENTION

It is an object of the present invention to provide a boom foot pin attachment and detachment apparatus for a construction machine not disturbing at the time of connection and removal works of hose pipes connected from the front side of an upper rotating body to winches on the boom side, and hence contributing to facilitation and acceleration of the works.

That is, the boom foot pin attachment and detachment apparatus for the construction machine according to the present invention has the following basic configuration.

That is, the boom foot pin attachment and detachment apparatus for the construction machine according to the present invention is based on the premise that the boom foot pin attachment and detachment apparatus comprises a bifurcated connection portion being formed on one of an upper rotating body and a boom foot, a flat plate connection portion inserted into the bifurcated connection portion being formed on the other, pin holes being provided in both the connection portions respectively. The boom foot pin attachment and detachment apparatus for the construction machine for inserting a boom foot pin into both the pin holes so as to detachably connect the boom foot with the upper rotating body in a state that both the pin holes are aligned, further comprises a cylinder bracket enabling the boom foot pin to move between an insertion position where the boom foot pin is inserted into the pin holes and a pull out position where the boom foot pin is pulled out from the pin hole, a base end of the cylinder bracket being attached to an inner piece of the bifurcated connection portion, a slide plate slidably provided on the cylinder bracket along the moving direction of the boom foot pin, a hydraulic cylinder, a cylinder main body thereof being attached to the slide plate and a piston rod thereof being connected to the boom foot pin, first regulating means for preliminarily regulating sliding of the slide plate when the boom foot pin is inserted from the pull out position into the pin holes by an extending action of the hydraulic cylinder, and second regulating means for preliminarily regulating movement of the boom foot pin from the insertion position when the hydraulic cylinder performs a contracting action after the boom foot pin is inserted into the pin holes by the extending action of the hydraulic cylinder.

In this configuration, when the boom foot pin is located on the pull out position on the cylinder bracket side and the hydraulic cylinder is supported through the slide plate in a state the hydraulic cylinder protrudes inwards from a front end of the cylinder bracket and in a contraction state that most of the piston rod are housed in the cylinder main body, the boom foot pin attachment and detachment apparatus extends in the width direction on the front side of the upper rotating body in the substantially same length as a conventional apparatus. When the boom foot pin is inserted into the pin holes from the above state, the first regulating means preliminarily regulates the sliding of the slide plate and then the hydraulic cylinder performs the extending action. Consequently, since movement of the cylinder main body of the hydraulic cylinder is regulated on the cylinder bracket as well as the slide plate on the attachment side, the boom foot pin connected to the piston rod is inserted into the pin holes from the pull out position following the extending action of the hydraulic cylinder.

Subsequently, while the regulation of the sliding of the slide plate by the first regulating means is released, the second regulating means regulates the movement of the boom foot pin from the insertion position, and then the hydraulic cylinder performs the contracting action. Then, movement of the piston rod of the hydraulic cylinder is regulated as well as the boom foot pin. Therefore, the cylinder main body of the hydraulic cylinder is moved on the cylinder bracket to the base end side thereof as well as the slide plate following the contracting action of the hydraulic cylinder, resulting in a state that the hydraulic cylinder is housed in the cylinder bracket. In this state, since length of the boom foot pin attachment and detachment apparatus is short, working space on the front side of the upper rotating body becomes large as a result and the boom foot pin attachment and detachment apparatus is hardly disturbing at the time of the connection and removal works of the hose pipes connected from the front side of the upper rotating body to the winches on the boom side. Further, the second regulating means also regulates the movement of the boom foot pin from the insertion position at the time of operating the construction machine and hence exercises a function as a conventional retaining member.

In the present invention, it is preferable that in the above configuration, the first regulating means and the second regulating means are formed by sharing one regulation plate.

That is, it is preferable that the regulation plate is selectively attached to a first position on the front end side of the cylinder bracket or a second position on the base end side, and a function of the first regulating means and a function of the second regulating means are exercised when the regulation plate is attached to the first position and to the second position respectively.

In this configuration, when the regulation plate is attached to the first position on the front end side of the cylinder bracket, the regulation plate exercises a function of the first regulating means for regulating the sliding of the slide plate. When the regulation plate is attached to the second position on the base end side of the cylinder bracket, the regulation plate exercises a function of the second regulating means for regulating the movement of the boom foot pin from the insertion position. Therefore, it is possible to reduce the number of parts by sharing the part.

In the present invention, it is preferable that in the above configuration, the cylinder bracket is formed in a channel shape having a bottom surface part and left and right side wall parts, and the slide plate is formed in a rectangular shape in correspondence with the channel shape of the cylinder bracket.

In this configuration, the slide plate is formed in a rectangular shape in correspondence with the channel shape of the cylinder bracket. Therefore, when the slide plate slides on the cylinder bracket by the extending action of the hydraulic cylinder, the slide plate smoothly slides without rotating.

In the present invention, it is preferable that in the above configuration, the piston rod of the hydraulic cylinder is connected to the boom foot pin through a connection plate, and the connection plate is formed in a rectangular shape in correspondence with the channel shape of the cylinder bracket.

In this configuration, the connection plate between the piston rod of the hydraulic cylinder and the boom foot pin is formed in a rectangular shape in correspondence with the channel shape of the cylinder bracket. Therefore, when the connection plate, that is the boom foot pin is moved between the pull out position on the cylinder bracket side and the insertion position by the extending action of the hydraulic cylinder, the boom foot pin is smoothly moved without rotating and the connection plate exercises a function of preventing rotation of the boom foot pin.

In the present invention, it is preferable that in the above configuration, the hydraulic cylinder is provided so as to be bent upward when the hydraulic cylinder itself is in a contraction state and the boom foot pin is located on the insertion position.

In this configuration, the hydraulic cylinder is provided so as to be bent upward, that is to the upper opening side of the cylinder bracket when the hydraulic cylinder is in a contraction state and the boom foot pin is located on the insertion position, in other words in a state that the hydraulic cylinder is housed in the cylinder bracket as mentioned above. As a result, it is possible to ensure wider working space on the front side of the upper rotating body at the time of the connection and removal works of the hose pipes connected from the front side of the upper rotating body to the winches on the boom side.

In the present invention, it is preferable that in the above configuration, the cylinder bracket is divided into a base end side bracket and a front end side bracket, and the front end side bracket is connected to the base end side bracket so as to be bent upward.

In this configuration, when the hydraulic cylinder is bent upward as mentioned above, by also bending the bracket on the front end of the cylinder bracket upward, it is possible to ensure further wider working space on the front side of the upper rotating body at the time of the connection and removal works of the hose pipes.

DESCRIPTION OF THE PREFERRED EMBODIMENTS

In the following, a description will be given to embodiments which are the best mode for carrying out the present invention on the basis of the drawings.

Figure 1:
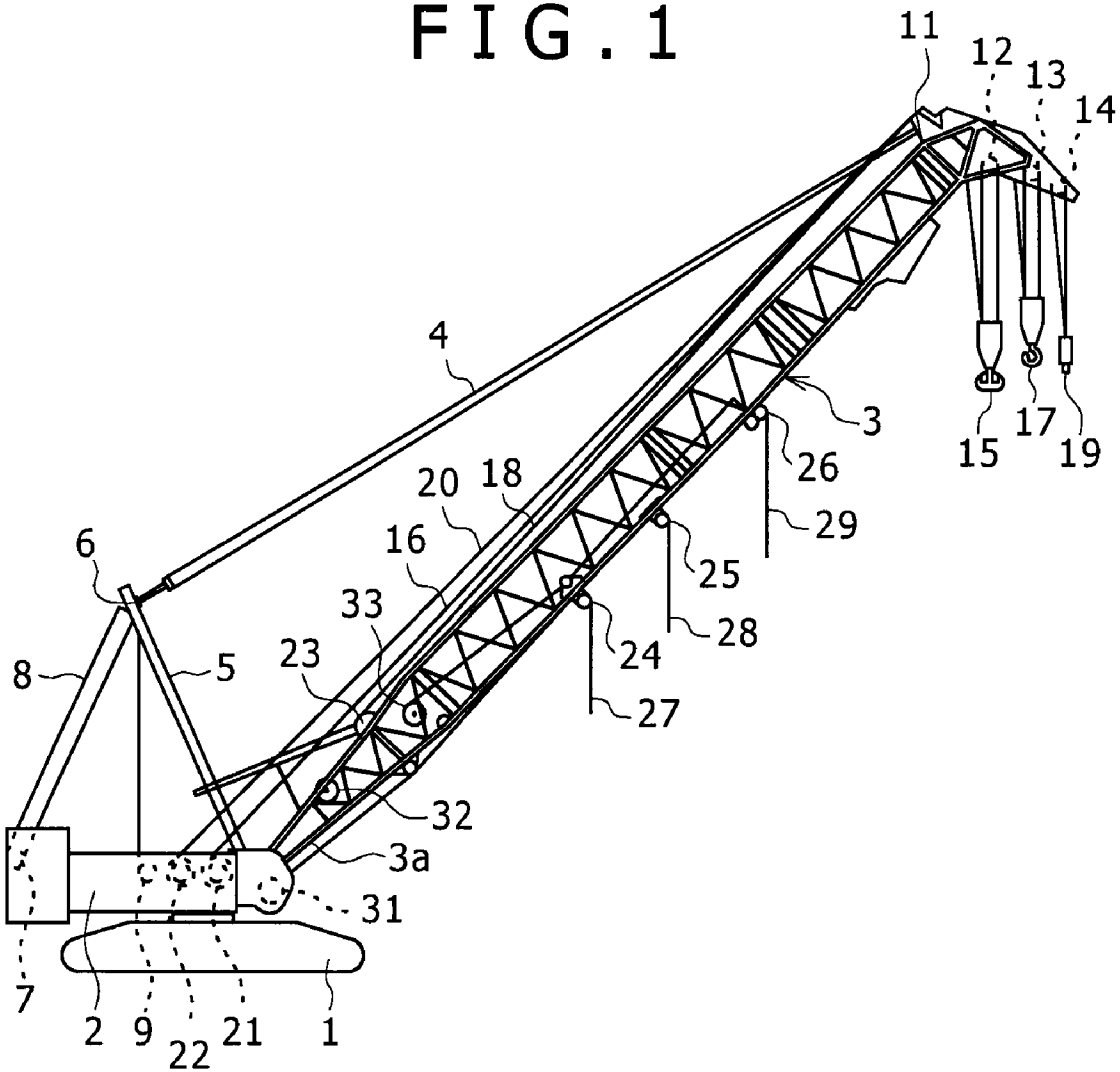
FIG. 1 is a side view of a crawler crane according to a first embodiment of the present invention.

FIG. 1 shows a crawler crane serving as a construction machine provided with a boom foot pin attachment and detachment apparatus according to a first embodiment of the present invention. The reference numeral 1 denotes a crawler type lower traveling body, and the reference numeral 2 denotes an upper rotating body rotatably mounted on the lower traveling body 1. On the front side of the upper rotating body 2, is attached a base end of a boom 3 which is a working attachment capable of raising and lowering.

To a front end part of the boom 3 is connected one end of a boom guy line 4. The other end of the boom guy line 4 is connected to an upper end part of a mast 5 tiltably attached to the upper rotating body 2. In the upper end part of the mast 5 is provided an upper spreader 6. Between the upper spreader 6 and a lower spreader 7 provided in a rear part of the upper rotating body 2 is wound a boom raising and lowering wire rope 8. One end of the boom raising and lowering wire rope 8 is wound around a boom raising and lowering winch 9 provided in the upper rotating body 2. The boom raising and lowering wire rope 8 is unwound from or wound up by the boom raising and lowering winch 9 so that the mast 5 is tilted in order to raise and lower the boom 3.

To the front end part of the boom 3 are attached an idler sheave 11, a boom point sheave 12, an intermediate sheave 13 and an auxiliary sheave 14. Amain hook 15 is supported by a main winding wire rope 16 and suspended from the boom point sheave 12, an intermediate hook 17 is supported by an intermediate winding wire rope 18 and suspended from the intermediate sheave 13, and an auxiliary hook 19 is supported by an auxiliary winding wire rope 20 and suspended from the auxiliary sheave 14. One end of the main winding wire rope 16 is fixed to the front end part of the boom 3, while the other end of the main winding wire rope 16 is wound around a first winch 21 provided in the upper rotating body 2 passing from the boom point sheave 12 through the idler sheave 11. The main hook 15 is wound up or down through the main winding wire rope 16 by the first winch 21. One end of the auxiliary winding wire rope 20 is fixed to the auxiliary hook 19, while the other end of the auxiliary winding wire rope 20 is wound around a second winch 22 provided in the upper rotating body 2 passing from the auxiliary sheave 14 through the idler sheave 11. The auxiliary hook 19 is wound up or down through the auxiliary winding wire rope 20 by the second winch 22. One end of the intermediate winding wire rope 18 is fixed to the front end part of the boom 3, while the other end of the intermediate winding wire rope 18 is wound around a third winch 23 provided in the base end part of the boom 3 passing from the intermediate sheave 13 through the idler sheave 11. The intermediate hook 17 is wound up or down through the intermediate winding wire rope 18 by the third winch 23.

To an intermediate part of the boom 3, are attached three guide sheaves 24, 25 and 26 in the longitudinal direction at a predetermined interval. From the guide sheaves 24 to 26 are suspended wire ropes 27, 28 and 29 respectively. The wire ropes 27 to 29 are to draw suspended cargoes on hand or change an attitude. The wire rope 27 is operated by a fourth winch 31 provided on the front side of the upper rotating body 2, the wire rope 28 is operated by a fifth winch 32 provided in the base end part of the boom 3, and the wire rope 29 is operated by a sixth winch 33 provided in the base end part of the boom 3.

Figure 2:
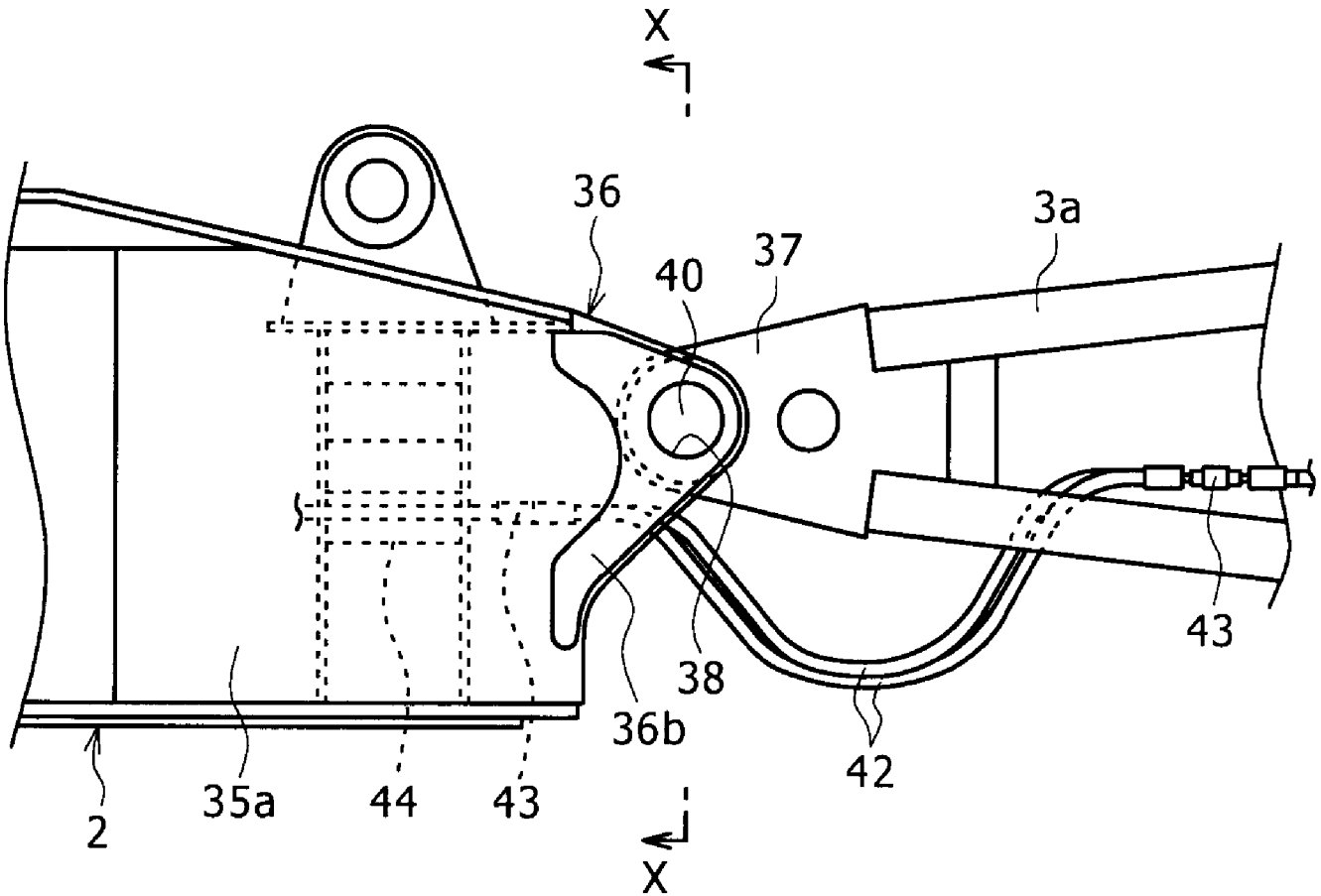
FIG. 2 is a side view showing a mechanism for attaching a boom foot to an upper rotating body of the crawler crane.
Figure 5:
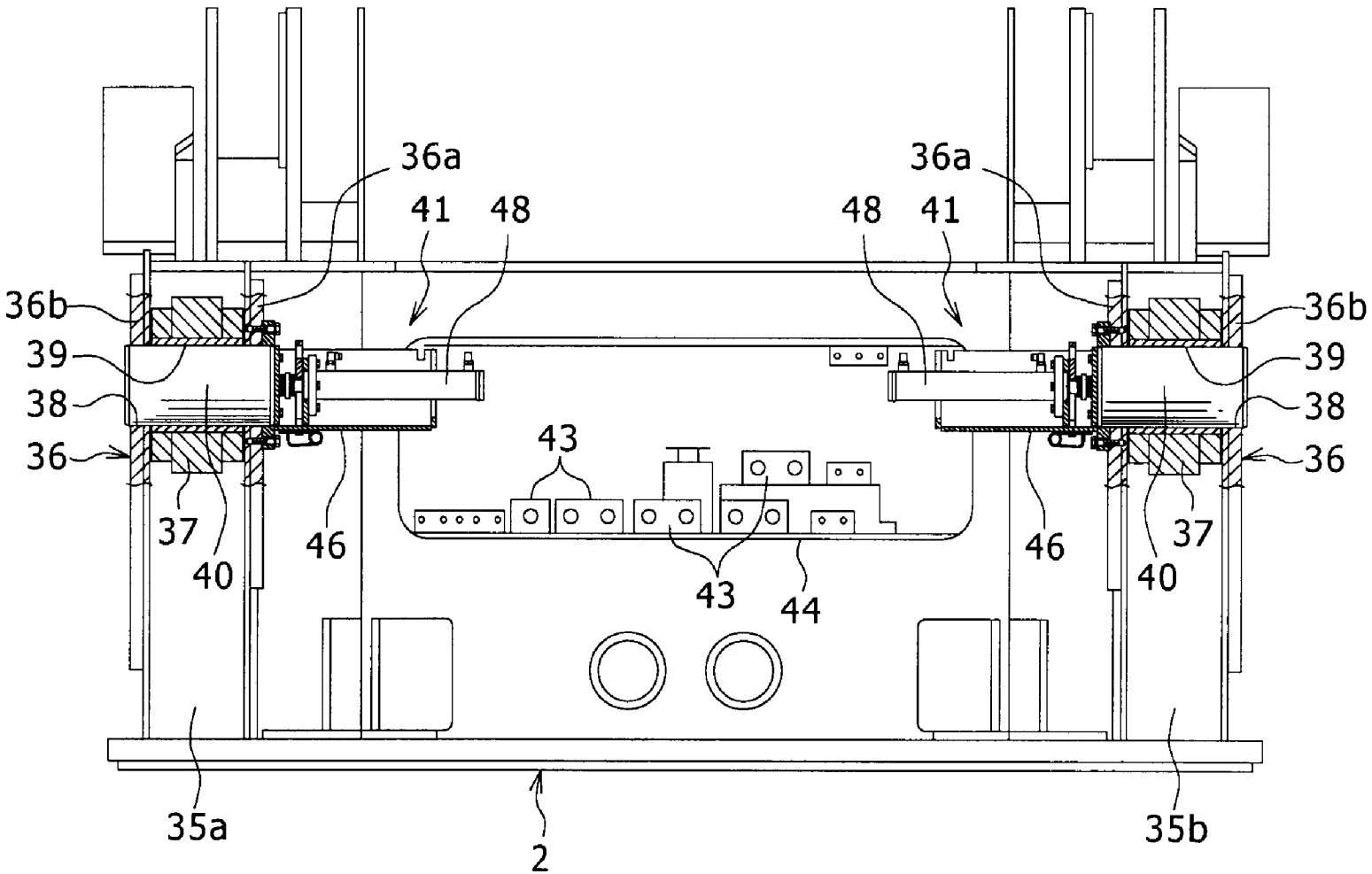
FIG. 5 is a partly cutaway arrow view seen along a line X-X of FIG. 2 showing a state that a hydraulic cylinder is housed in a cylinder bracket.

A mechanism for attaching the base end of the boom 3, that is a boom foot 3*a* to the front side of the upper rotating body 2 is shown in FIG. 2 or FIG. 5. That is, a bifurcated connection portion 36 is respectively formed on front end parts of left and right frames 35*a* and 35*b* of the upper rotating body 2, while a flat plate connection portion 37 inserted between an inner piece 36*a* and an outer piece 36*b* of the connection portions 36 is respectively formed on both left and right sides of the boom foot 3*a*. In both the connection portions 36 and 37 are provided pin holes 38 and 39 respectively. In a state that both the pin holes 38 and 39 are aligned on both the left and right sides, a boom foot pin 40 is inserted from the inside into both the pin holes 38 and 39 so as to detachably connect the boom foot 3*a* with the front side of the upper rotating body 2, and the connection is automatically performed. For this, a pair of left and right boom foot pin attachment and detachment apparatuses 41 according to the first embodiment of the present invention are provided.

Meanwhile, in order to move the third winch 23, the fifth winch 32 and the sixth winch 33 provided in the boom 3, a plurality of winch hose pipes 42 are arranged bridging from the front side of the upper rotating body 2 to the boom foot 3*a*. The winch hose pipes 42 are provided so as to be freely connected and removed by using quick couplers 43 or the like since the winch hose pipes 42 are required to be removed at the time of detaching the boom 3. On the front side of the upper rotating body 2, the quick couplers 43 are aligned and attached on a horizontal base part 44.

Figure 3:
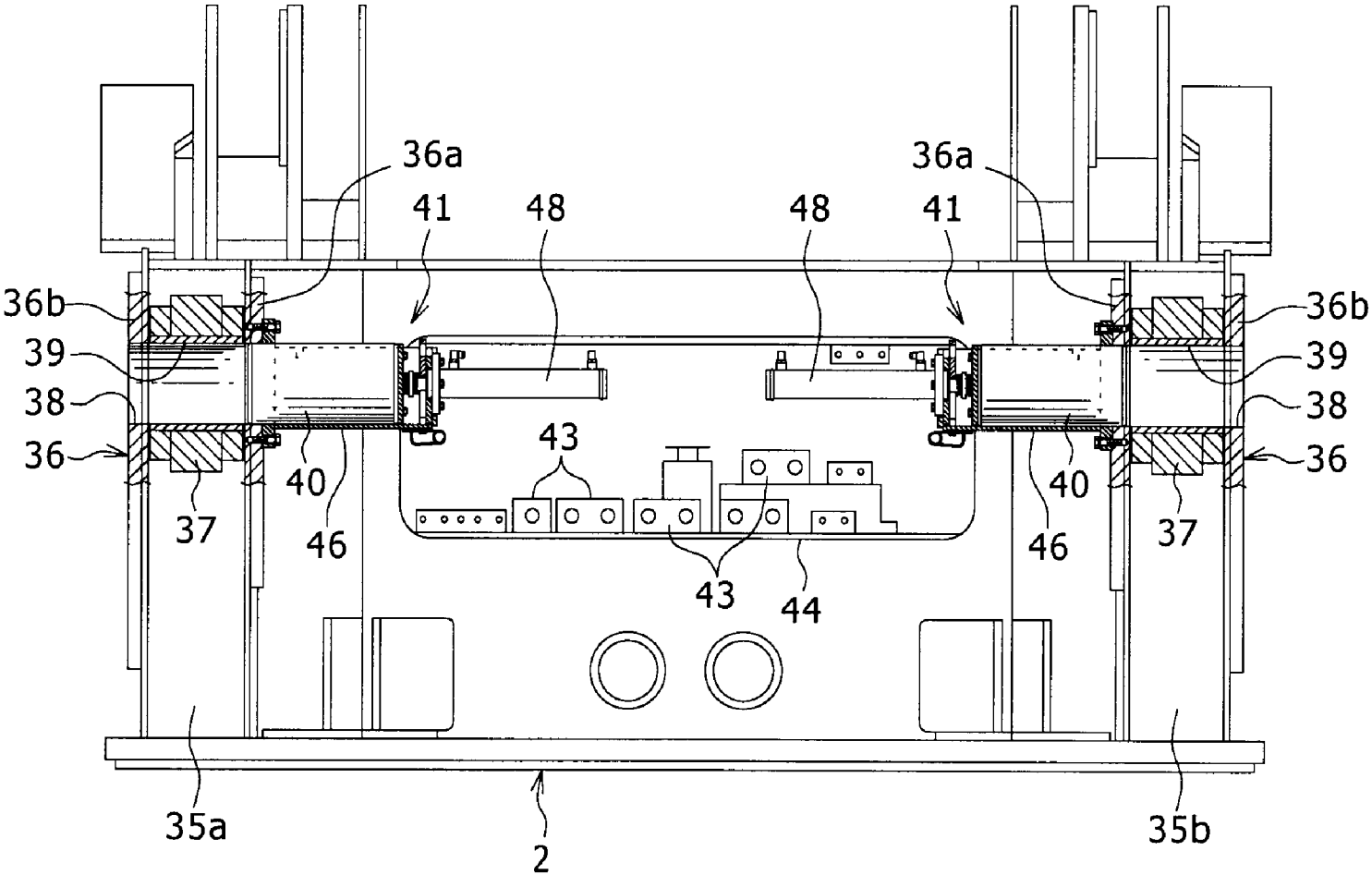
FIG. 3 is a partly cutaway arrow view seen along a line X-X of FIG. 2 showing a state that a boom foot pin is pulled out from pin holes.
Figure 4:
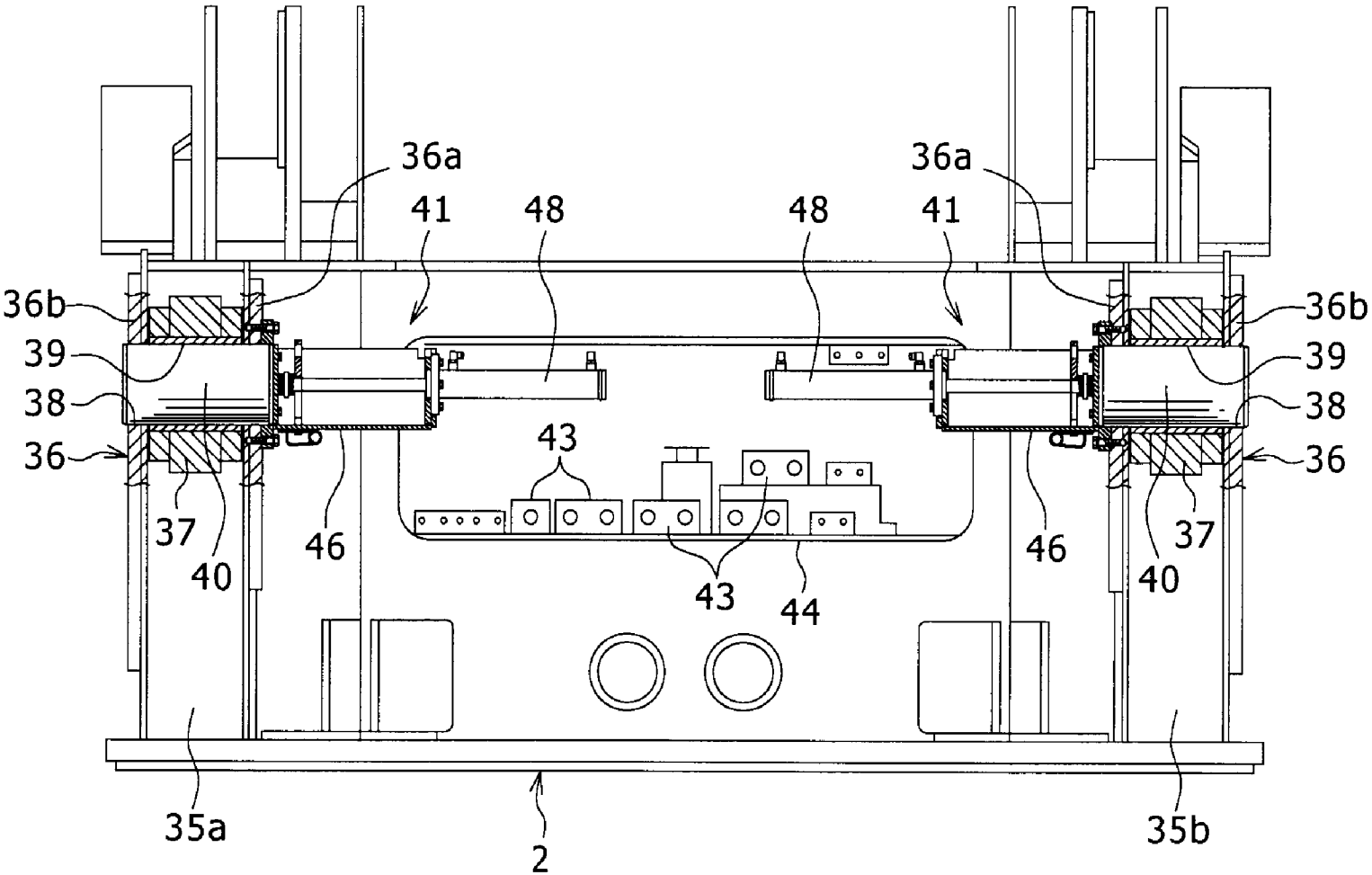
FIG. 4 is a partly cutaway arrow view seen along a line X-X of FIG. 2 showing a state that the boom foot pin is inserted into the pin holes.

As shown in FIGS. 3 and 4, the pair of boom foot pin attachment and detachment apparatuses 41 are arranged inside the left and right frames 35*a* and 35*b* on the front side of the upper rotating body 2 extending to the vicinity of the center line, and overlaps the quick couplers 43 attached on the horizontal base part 44 on the front side of the upper rotating body 2 one above the other in the longitudinal direction. Therefore, when the connection and removal works of the winch hose pipes 42 is performed, the pair of boom foot pin attachment and detachment apparatuses 41 are disturbing. However, in order to avoid the disturbance, the boom foot pin attachment and detachment apparatus 41 according to the first embodiment of the present invention is formed so as to have short length as shown in FIG. 5. Since the pair of left and right boom foot pin attachment and detachment apparatuses 41 have the same configuration, in the following, a description will be given taking the boom foot pin attachment and detachment apparatus 41 on the right side seen from the front as an example.

That is, the boom foot pin attachment and detachment apparatus 41 is, as enlarged and shown in FIGS. 6 to 10 in detail, attached to the inner piece 36*a* of the bifurcated connection portion 36 and provided with a cylinder bracket 46 enabling the boom foot pin 40 to move between the insertion position where the boom foot pin 40 is inserted into the pin holes 38 and 39 and the pull out position where the boom foot pin 40 is pulled out from the pin holes 38 and 39, a slide plate 47 slidably provided on the cylinder bracket 46 along the moving direction of the boom foot pin 40, a hydraulic cylinder 48 in which a cylinder main body 48*a* thereof is attached to the slide plate 47 and a piston rod 48*b* thereof is connected to the boom foot pin 40 through a connection plate 49, and a regulation plate 50 for selectively regulating one of the sliding of the slide plate 47 and the movement of the boom foot pin 40 from the insertion position.

Figure 11A:
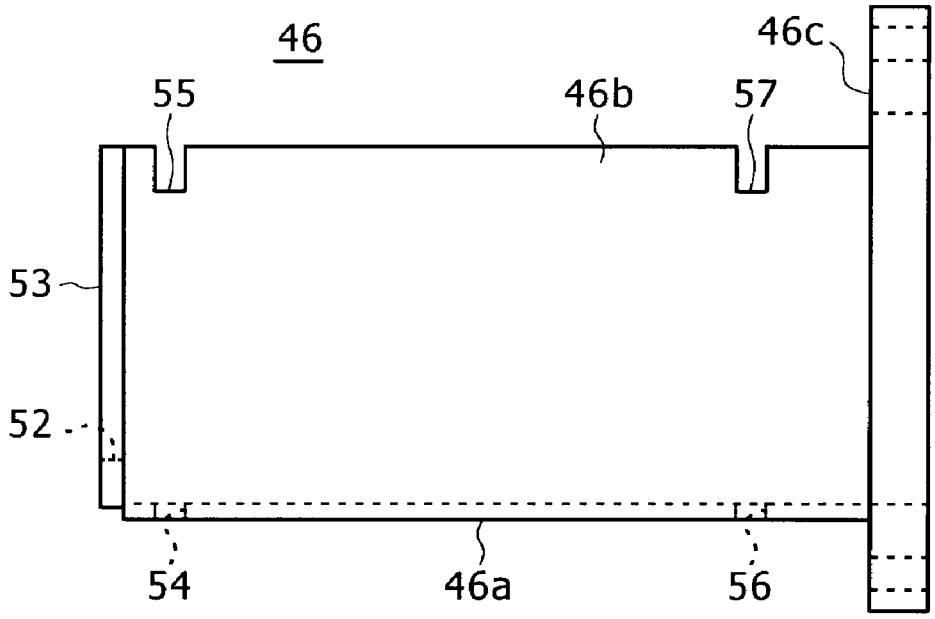
FIGS. 11A and 11B are a side view and a bottom view respectively, showing the cylinder bracket.
Figure 11B:
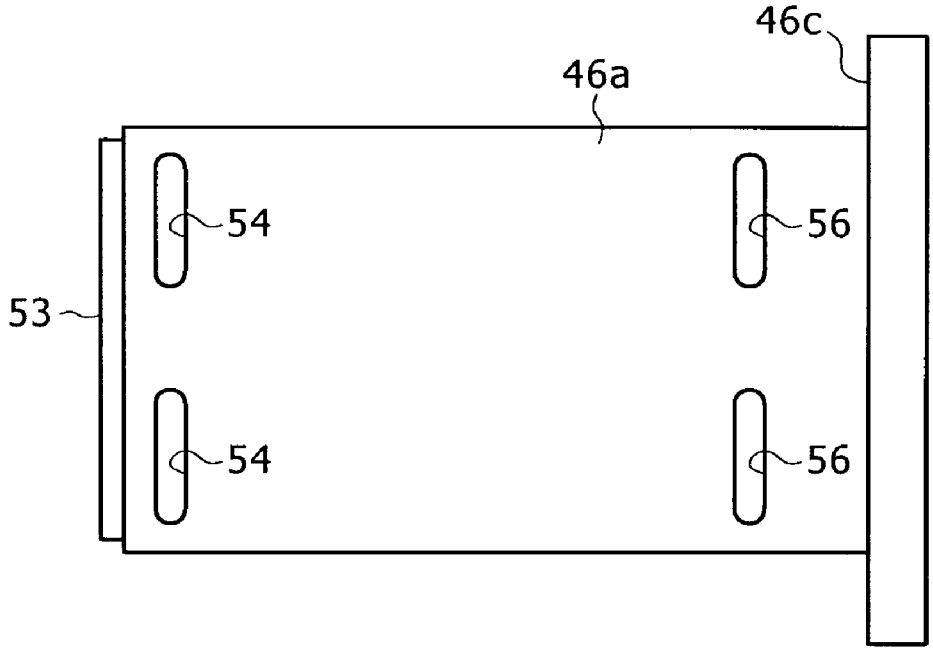
Figure 12:
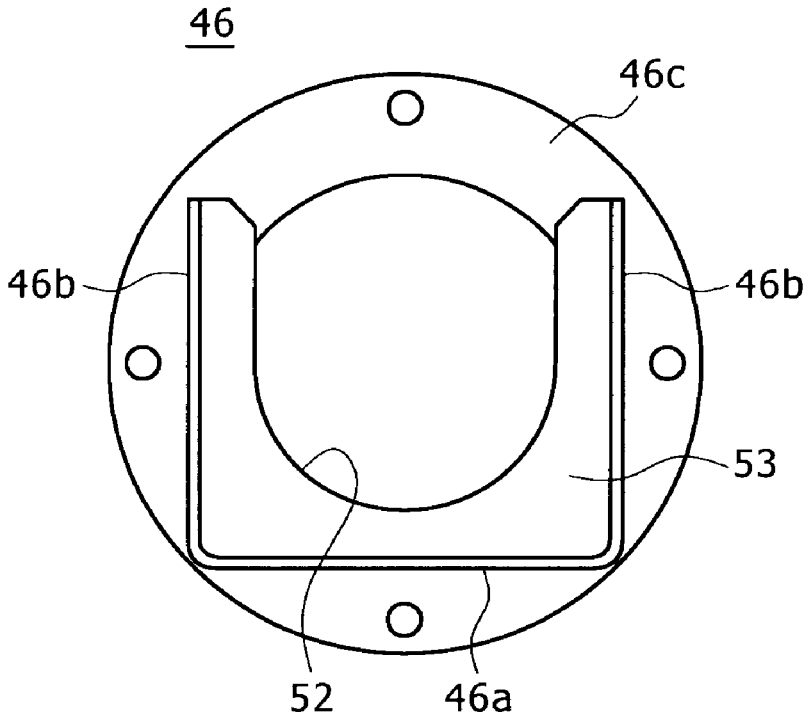
FIG. 12 is a front view of the cylinder bracket.

The cylinder bracket 46 is, as shown in FIGS. 11A, 11B and 12, formed in a channel shape having a bottom surface part 46*a* and left and right side wall parts 46*b*. To a base end of the cylinder bracket 46 is fixed a flange part 46*c*. By holding the flange part 46*c* onto the inner piece 36*a* of the bifurcated connection portion 36 by bolts 51, the cylinder bracket 46 is attached to the inner piece 36*a* of the connection portion 36, and an end plate 53 having a cutout portion 52 in a U shape is fixed to a front end of the cylinder bracket 46. On the front end side of the cylinder bracket 46, are provided two first insertion holes 54 in a slit shape aligned in the bottom surface part 46*a* with sandwiching the center line as first positions, and a first cutout groove 55 formed by cutting out an upper edge of the side wall part 46*b* into a concave shape. On the base end side of the cylinder bracket 46, are provided two second insertion holes 56 in a slit shape aligned in the bottom surface part 46*a* with sandwiching the center line as second positions, and a second cutout groove 57 formed by cutting out an upper edge of the side wall part 46*b* into a concave shape.

Figure 9:
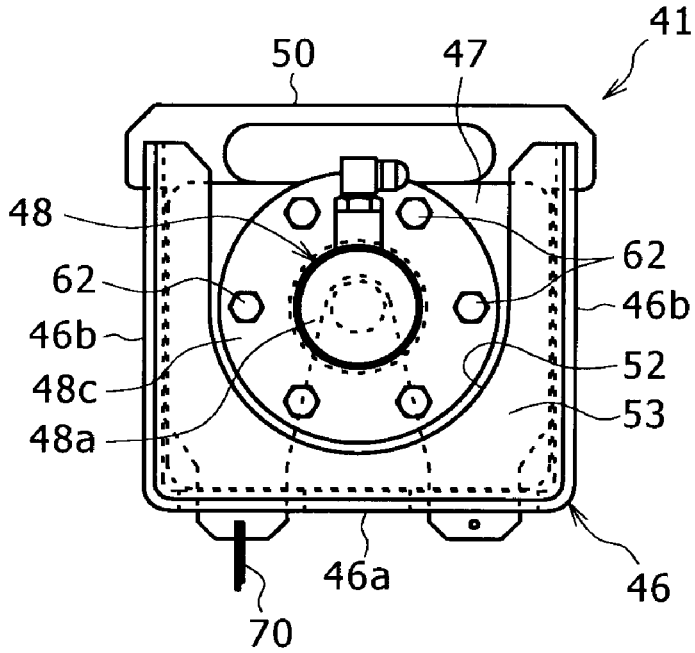
FIG. 9 is an enlarged arrow view seen along a line Y-Y of FIG. 6.
Figure 13:
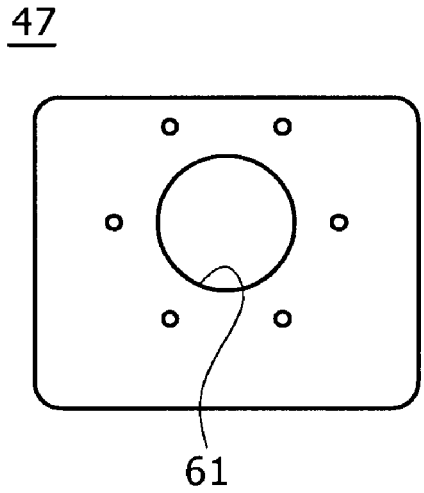
FIG. 13 is a front view of a slide plate.

The slide plate 47 is, as shown in FIG. 13 in detail, formed in a rectangular shape in correspondence with the channel shape of the cylinder bracket 46. An attachment hole 61 is provided on the upper side of the center of the slide plate 47. In a state that the piston rod 48*b* of the hydraulic cylinder 48 passes through the attachment hole 61 and an front end of the cylinder main body 48*a* is fitted with the attachment hole 61, the flange part 48*c* provided in the cylinder main body 48*a* is brought into abutment with the slide plate 47 so as to hold the flange part 48*c* by bolts 62. Therefore, the cylinder main body 48*a* is attached to the slide plate 47. The flange part 48*c* is, as shown in FIG. 9, set to have size that seen in the axial direction of the hydraulic cylinder 48, the cutout portion 52 of the end plate 53 on the front end side of the cylinder bracket 46 does not interfere with the flange part 48*c*.

Figure 14:
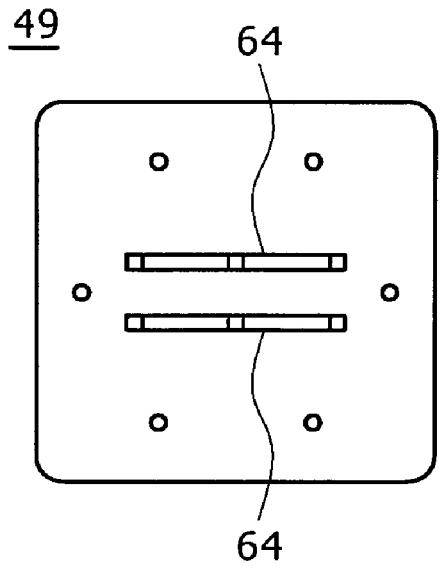
FIG. 14 is a front view of a connection plate.

The connection plate 49 is, as shown in FIG. 14 in detail, formed in a rectangular shape in correspondence with the channel shape of the cylinder bracket 46. By bringing a back surface of the connection plate 49 into abutment with the boom foot pin 40 and held by bolts 63, the connection plate 49 and the boom foot pin 40 are connected to each other. In a surface of the connection plate 49, are provided a pair of top and bottom horizontal protrusion pieces 64. The front end part of the piston rod 48*b* of the hydraulic cylinder 48 is inserted between both the horizontal protrusion pieces 64 and the front end part and the horizontal protrusion pieces 64 are connected by a connection pin 65.

Figure 6:
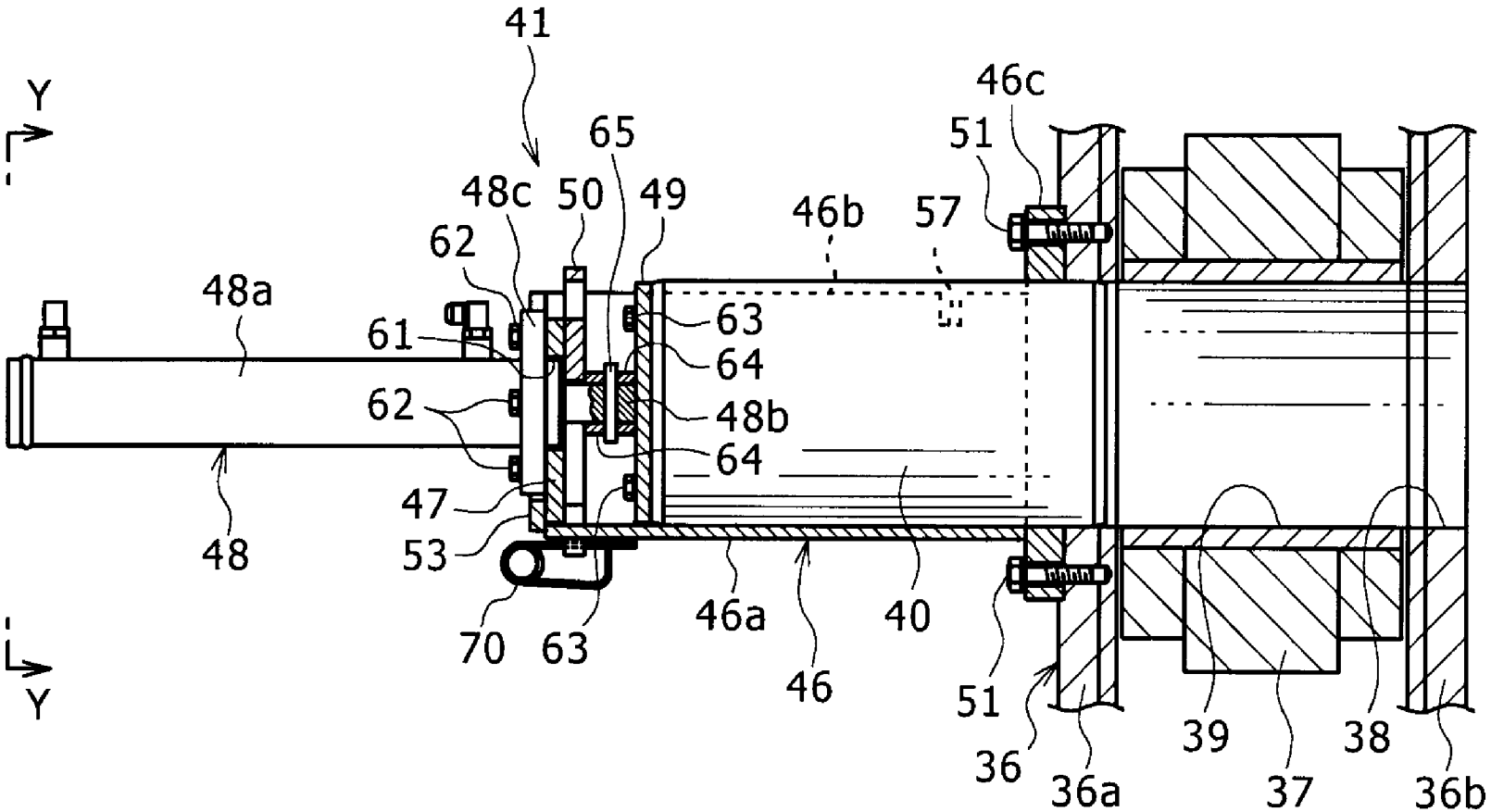
FIG. 6 is an enlarged view of the vicinity of a boom foot pin attachment and detachment apparatus on the right side of FIG. 3.
Figure 7:
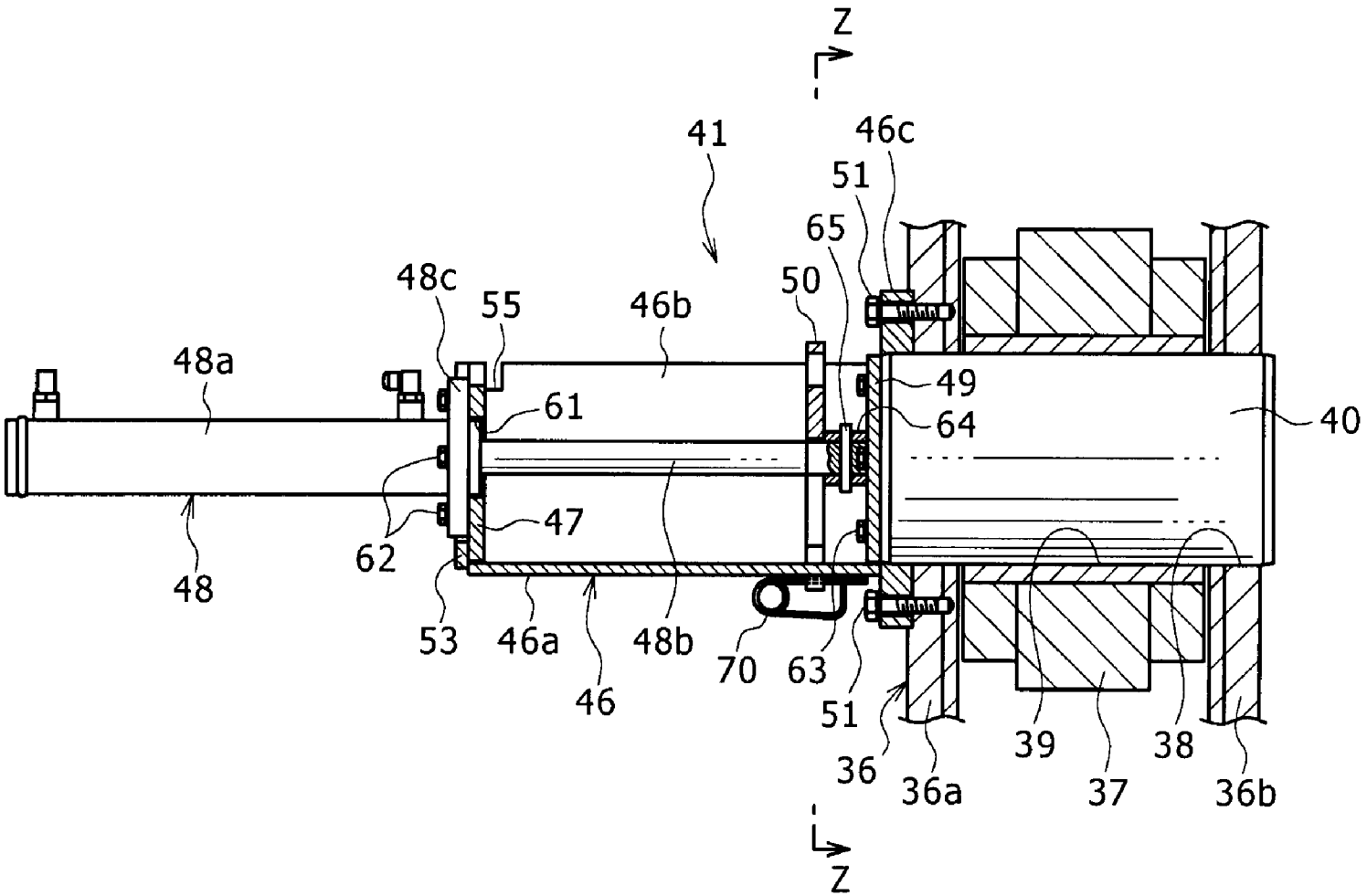
FIG. 7 is an enlarged view of the vicinity of a boom foot pin attachment and detachment apparatus on the right side of FIG. 4.
Figure 8:
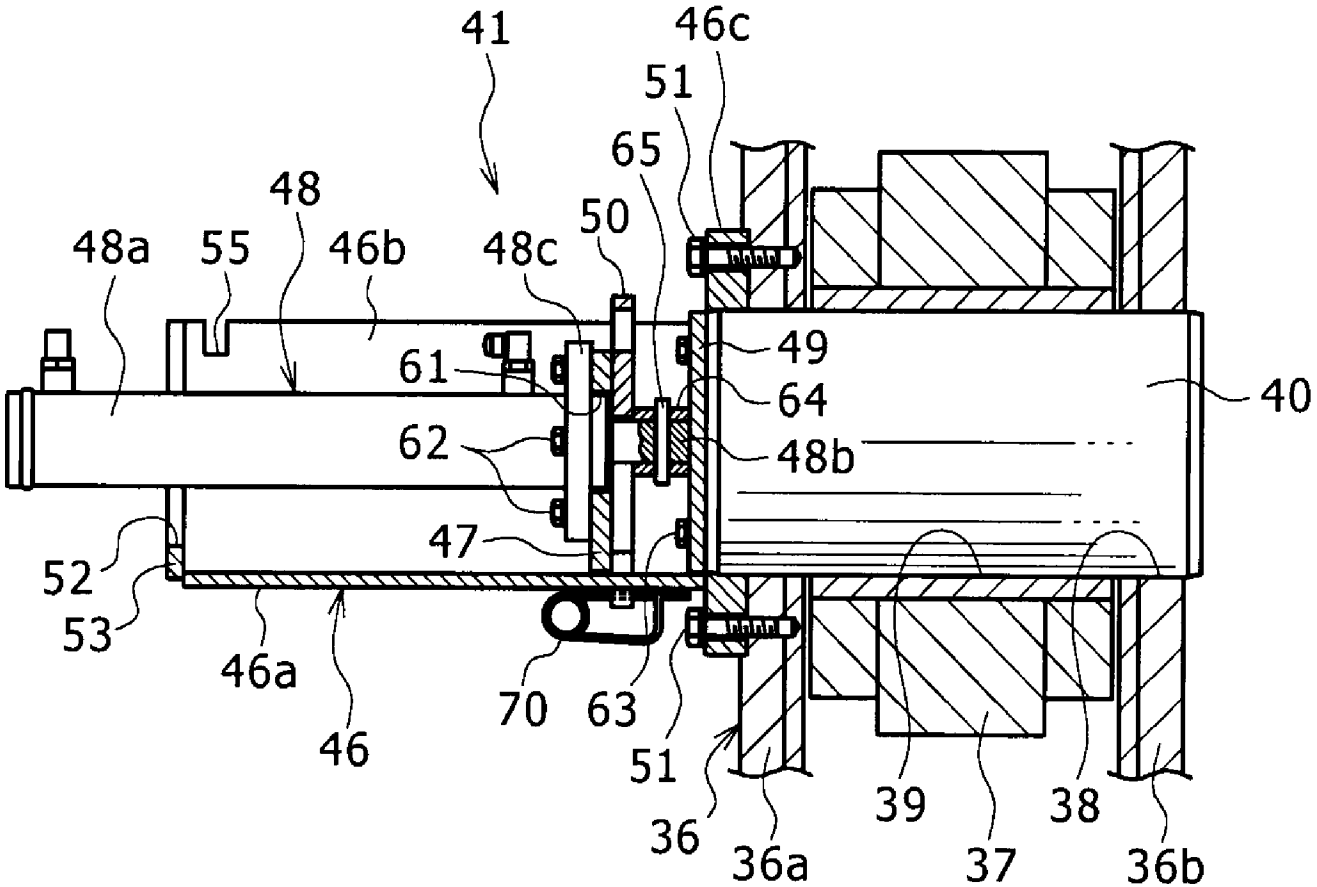
FIG. 8 is an enlarged view of the vicinity of a boom foot pin attachment and detachment apparatus on the right side of FIG. 5.
Figure 10:
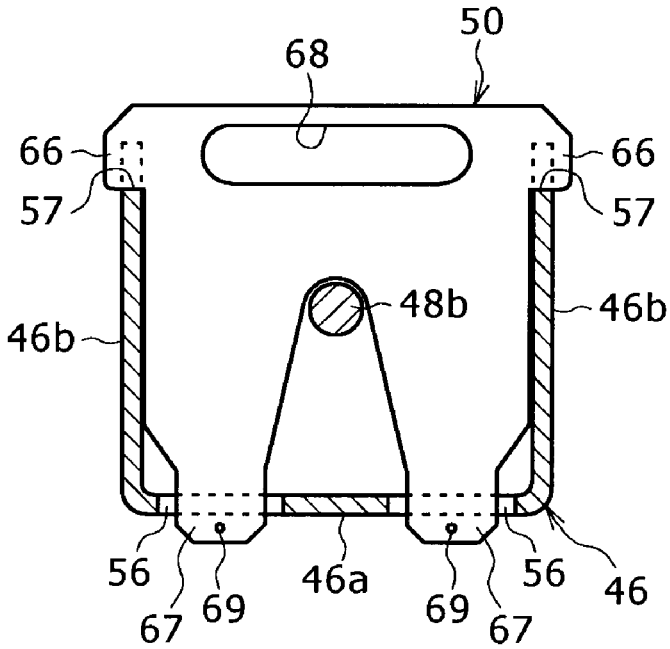
FIG. 10 is an enlarged sectional view by a line Z-Z of FIG. 7.
Figure 15:
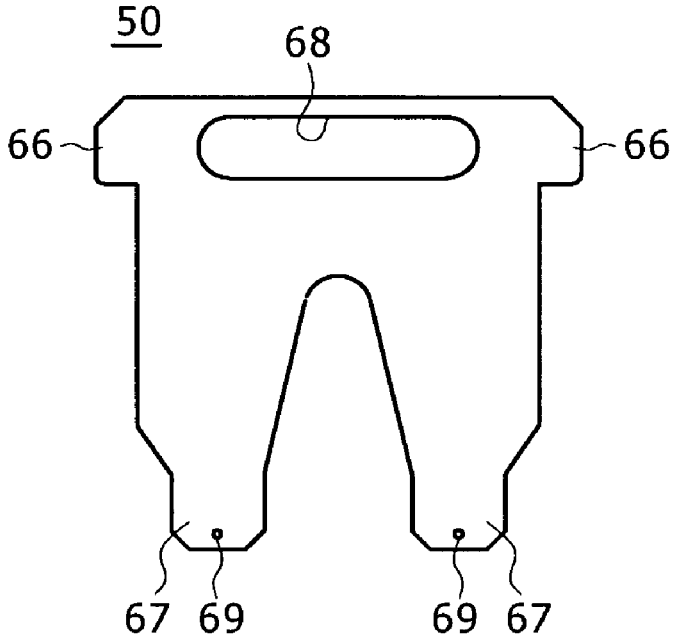
FIG. 15 is a front view of a regulation plate.

Further, the regulation plate 50 is, as shown in FIGS. 10 and 15 in detail, bifurcated so as to be inserted into the cylinder bracket 46 from the upper side thereof. In left and right edges of an upper part of the regulation plate 50, are formed a pair of shoulder portions 66 which are to be inserted into the first cutout groove 55 or the second cutout groove 57 of the side wall part 46*b* of the cylinder bracket 46. In a lower part of the regulation plate 50, in a state of bridging the piston rod 48*b* of the hydraulic cylinder 48, are formed a pair of foot portions 67 which are to be inserted into the first insertion holes 54 or the second insertion holes 56 of the bottom surface part 46*a* of the cylinder bracket 46. As shown in FIG. 6, when the slide plate 47 is located on the front end of the cylinder bracket 46, the regulation plate 50 is inserted into the first position on the front end side of the cylinder bracket 46 adjacent to the slide plate 47, the shoulder portions 66 of the regulation plate 50 are put into the first cutout groove 55 of the side wall part 46*b* of the cylinder bracket 46, and the foot portions 67 of the regulation plate 50 are inserted into the first insertion holes 54 of the bottom part 46*a* of the cylinder bracket 46. Therefore, when the regulation plate 50 is attached to the first position as above, the sliding of the slide plate 47 is regulated by the regulation plate 50. As shown in FIGS. 7 and 8, when the boom foot pin 40 is located on the insertion position, the regulation plate 50 is inserted into the second position on the base end side of the cylinder bracket 46, the shoulder portions 66 of the regulation plate 50 are put into the second cutout groove 57 of the side wall part 46*b* of the cylinder bracket 46, and the foot portions 67 of the regulation plate 50 are inserted into the second insertion holes 56 of the bottom part 46*a* of the cylinder bracket 46. Therefore, when the regulation plate 50 is attached to the second position as above, the movement of the boom foot pin 40 from the insertion position is regulated by contact between the regulation plate 50 and the connection plate 49. Consequently, the regulation plate 50 exercises both a function as first regulating means for preliminarily regulating the sliding of the slide plate 47 when the boom foot pin 40 is inserted into the pin holes 38 and 39 from the pull out position by an extending action of the hydraulic cylinder 48, and a function as second regulating means for preliminarily regulating the movement of the boom foot pin 40 from the insertion position when the hydraulic cylinder 48 performs a contracting action after the boom foot pin 40 is inserted into the pin holes 38 and 39 by the extending action of the hydraulic cylinder 48.

It should be noted that in FIGS. 10 and 15, the reference numeral 68 denotes an opening for grip provided in the upper part of the regulation plate 50 and the reference numeral 69 denotes a small hole provided in the front end part of the foot portions 67 of the regulation plate 50. When the regulation plate 50 is attached to the first position on the front end side of the cylinder bracket 46 or the second position on the base end side, a retaining pin 70 (refer to FIGS. 6 to 9) is arranged into the small hole 69 of at least one foot portion 67 of the regulation plate 50 protruding downward from the first insertion holes 54 or the second insertion holes 56 of the bottom surface part 46*a* of the cylinder bracket 46 so as to prevent removal of the regulation plate 50 from the first position or the second position of the cylinder bracket 46.

Next, an action of the boom foot pin attachment and detachment apparatus 41 will be described. As shown in FIG. 6, the slide plate 47 is located on the front end of the cylinder bracket 46, the hydraulic cylinder 48 attached to the slide plate 47 is in a contraction state that most of the piston rod 48*b* are housed in the cylinder main body 48, and the boom foot pin 40 is pulled out from the pin holes 38 and 39 and located on the pull out position on the cylinder bracket 46 side. The regulation plate 50 is attached to the first position on the front end side of the slide plate 47 adjacent to the slide plate 47.

When the hydraulic cylinder 48 performs the extending action from such a state, the cylinder main body 48*a* is fixed on the cylinder bracket 46 by the slide plate 47 and the regulation plate 50. Therefore, the piston rod 48*b* extends with pushing the boom foot pin 40 to the pin holes 38 and 39 side and the boom foot pin 40 is inserted into the pin holes 38 and 39. After the boom foot pin 40 is moved to the insertion position, the regulation plate 50 is removed from the first position on the front end side of the slide plate 47 and attached to the second position on the base end side as shown in FIG. 7.

Subsequently, when the hydraulic cylinder 48 performs the contracting action, the movement of the boom foot pin 40 from the insertion position is regulated by the regulation plate 50 and the boom foot pin 40 is connected with the piston rod 48*b*. Therefore, the cylinder main body 48*a* is moved from the front end side to the base end side on the cylinder bracket 46 integrally with the slide plate 47, and stopped on a position where the slide plate 47 is brought in contact with the regulation plate 50 as shown in FIG. 8. At this time, the length of the boom foot pin attachment and detachment apparatus 41 becomes short and the overlap with the quick couplers 43 attached on the horizontal base part 44 on the front side of the upper rotating body 2 is almost avoided as shown in FIG. 5.

As mentioned above, according to the boom foot pin attachment and detachment apparatus 41 of the present embodiment, when the hydraulic cylinder 48 performs the contracting action after the boom foot pin 40 is inserted into the pin holes 38 and 39, the cylinder main body 48*a* is moved from the front end side to the base end side of the cylinder bracket 46 so that the length of the attachment and detachment apparatus 41 becomes short. Therefore, working space on the front side of the upper rotating body 2 becomes wider and the overlap with the quick couplers 43 attached on the horizontal base part 44 on the front side of the upper rotating body 2 is almost avoided. Consequently, the boom foot pin attachment and detachment apparatus 41 is hardly disturbing at the time of the connection and removal works of the winch hose pipes 42 connected to the winches 23, 32 and 33 on the boom 3 side by using the quick couplers 43, and hence it is possible to contribute to facilitation and acceleration of the works.

Further, when the boom foot pin 40 is located on the insertion position where the boom foot pin 40 is inserted into the pin holes 38 and 39, the movement of the boom foot pin 40 from the insertion position is regulated by the regulation plate 50. Therefore, it is possible to ensure retaining the boom foot pin 40 in the pin holes 38 and 39 at the time of crane work, and it is advantageous for bringing into practice.

The regulation plate 50 has not only the function for regulating the movement of the boom foot pin 40 from the insertion position but also a function for regulating movement of the slide plate 47. Therefore, it is possible to reduce the number of parts and contribute to cost reduction and facilitation of parts management.

Further, the cylinder bracket 46 is formed in a channel shape having the bottom surface part 46*a* and the left and right side wall parts 46*b*, and the slide plate 47 is formed in a rectangular shape in correspondence with the channel shape of the cylinder bracket 46. Therefore, when the slide plate 47 slides on the cylinder bracket 46 by the contracting action of the hydraulic cylinder 48, the slide plate 47 can smoothly slide without rotating and hence it is possible to enhance reliability of the action.

In addition, the connection plate 49 between the piston rod 48*b* of the hydraulic cylinder 48 and the boom foot pin 40 is also formed in a rectangular shape in correspondence with the channel shape of the cylinder bracket 46. Therefore, when the connection plate 49, that is the boom foot pin 40 is moved between the pull out position and the insertion position on the cylinder bracket 46 side by the contracting action of the hydraulic cylinder 48, the boom foot pin 40 can be smoothly moved without rotating. In other words, the connection plate 49 exercises a function of preventing rotation of the boom foot pin 40. Therefore, it is possible to reduce the number of parts and further contribute to the const reduction or the like.

Figure 16:
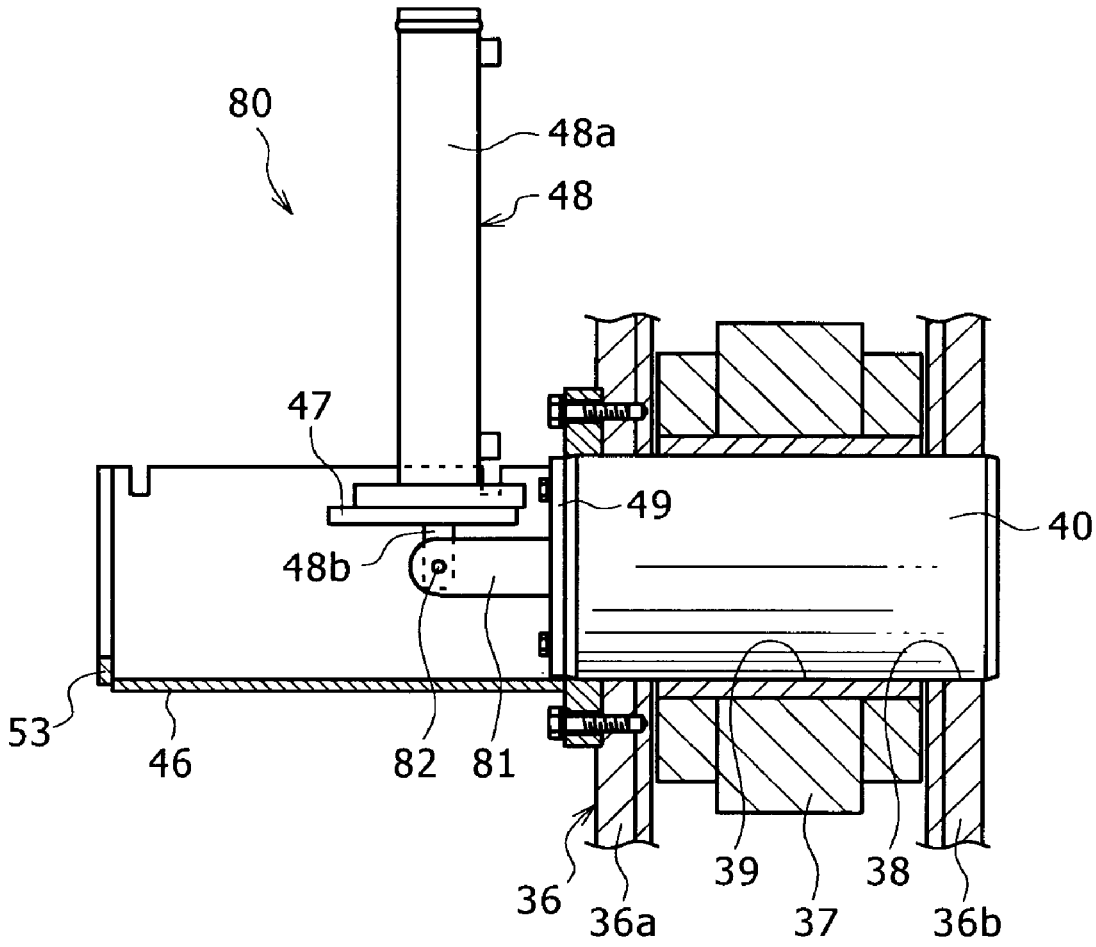
FIG. 16 is a partly cutaway sectional view showing a state that a hydraulic cylinder of a boom foot pin attachment and detachment apparatus according to a second embodiment is bent upward.

FIG. 16 shows a boom foot pin attachment and detachment apparatus 80 according to a second embodiment of the present invention. In the case of the boom foot pin attachment and detachment apparatus 80, a pair of left and right horizontal protrusion pieces 81 (only one horizontal protrusion piece is shown in the figure) extending relatively long from the connection plate 49 connected to the boom foot pin 40 to the inside is provided, the front end part of the piston rod 48*b* of the hydraulic cylinder 48 is inserted between both the horizontal protrusion pieces 81, and the piston rod 48*b* and the horizontal protrusion pieces 81 are connected by a connection pin 82 extending in the horizontal direction which is orthogonal to the piston rod 48*b* and the horizontal protrusion pieces 81. By this, when the hydraulic cylinder 48 is in a contraction state and the boom foot pin 40 is located on the insertion position, the hydraulic cylinder 48 is bent upward at a substantially right angle taking the connection pin 82 as center. It should be noted that other configurations of the boom foot pin attachment and detachment apparatus 80 are the same as the boom foot pin attachment and detachment apparatus 41 according to the first embodiment, and the same members are given the same reference numerals and explanation thereof will be omitted.

In the boom foot pin attachment and detachment apparatus 80, when the hydraulic cylinder 48 is in a contraction state and the boom foot pin 40 is located on the insertion position, in other words, when the hydraulic cylinder 48 is housed in the cylinder bracket 46 while a part thereof protrudes from the front end of the cylinder bracket 46 to the inside, the hydraulic cylinder 48 is bent upward at a substantially right angle. Therefore, it is possible to ensure wider working space on the front side of the upper rotating body 2 at the time of the connection and removal works of the winch hose pipes 42 (refer to FIG. 2), and there is an effect of further contributing to the facilitation and the acceleration of the works.

Figure 17:
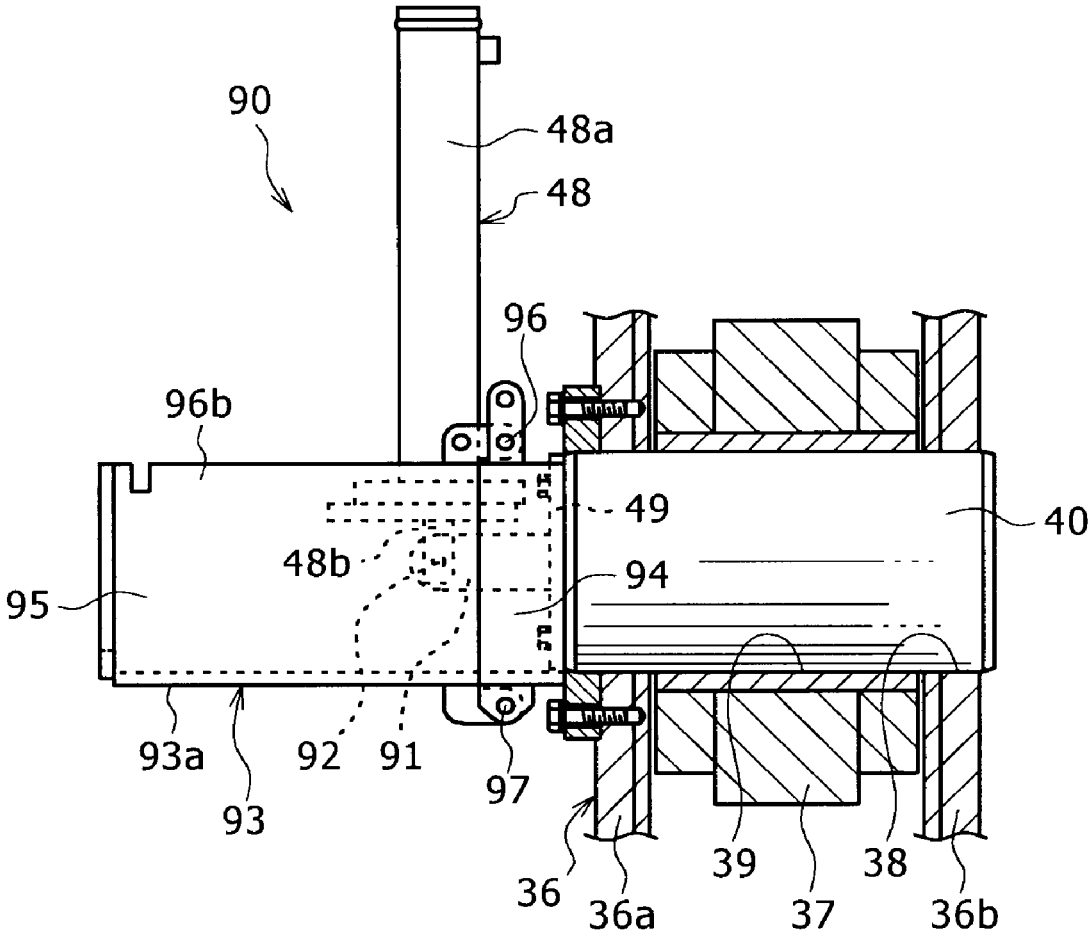
FIG. 17 is a partly cutaway sectional view showing a state that a hydraulic cylinder of a boom foot pin attachment and detachment apparatus according to a third embodiment is bent upward.
Figure 18:
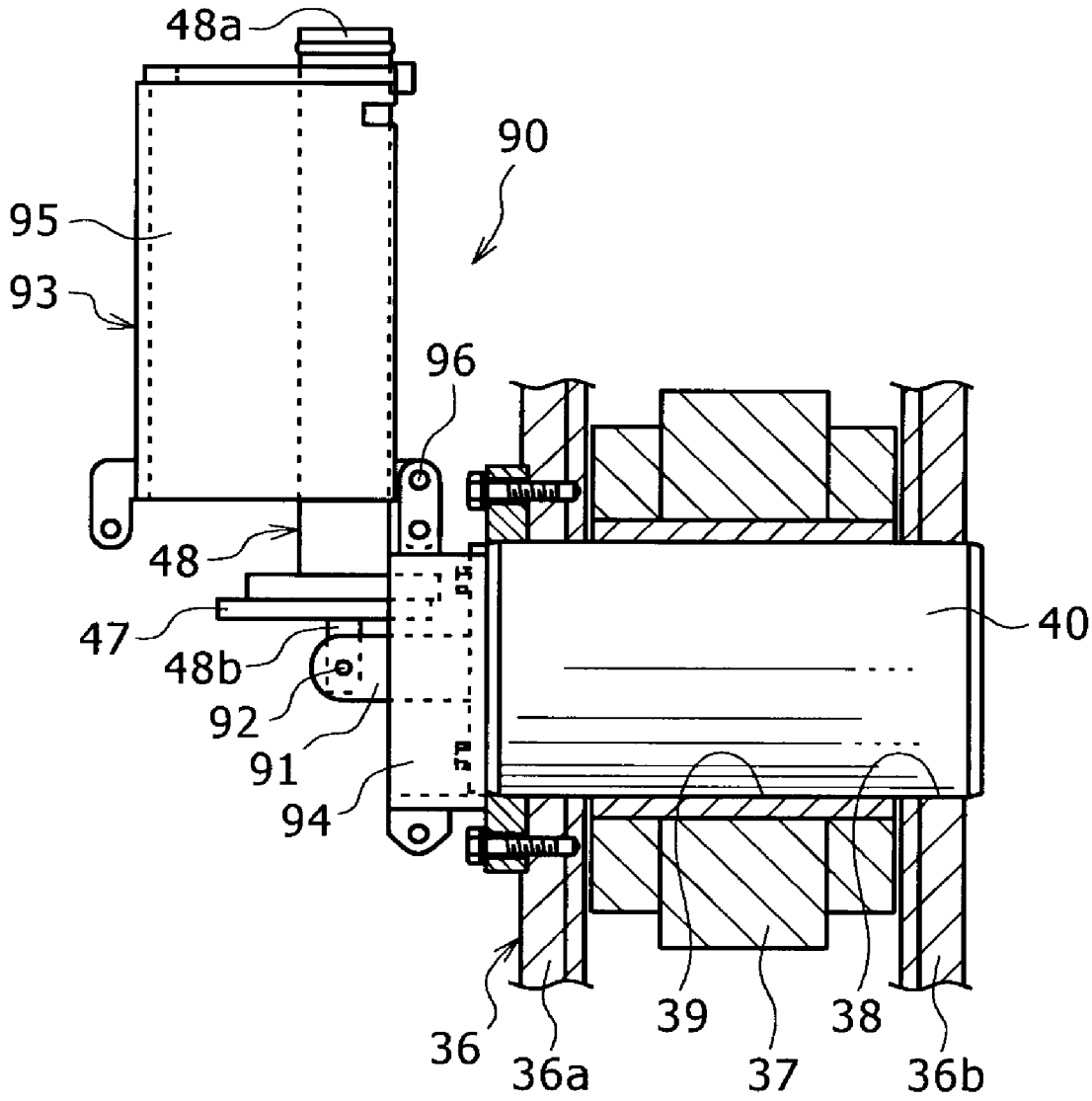
FIG. 18 is a partly cutaway sectional view showing a state that a bracket on the front side of the cylinder bracket is further bent upward from the above state of the boom foot pin attachment and detachment apparatus.

FIGS. 17 and 18 show a boom foot pin attachment and detachment apparatus 90 according to a third embodiment of the present invention. In the case of the boom foot pin attachment and detachment apparatus 90, as well as the boom foot pin attachment and detachment apparatus 80 according to the second embodiment, a pair of left and right horizontal protrusion pieces 91 (only one horizontal protrusion piece is shown in the figure) extending relatively long from the connection plate 49 connected to the boom foot pin 40 to the inside is provided, and the front end part of the piston rod 48*b* of the hydraulic cylinder 48 is inserted between both the horizontal protrusion pieces 91. Then the piston rod 48*b* and the horizontal protrusion pieces 91 are connected by a connection pin 92 extending in the horizontal direction which is orthogonal to the piston rod 48*b* and the horizontal protrusion pieces 91. By this, when the hydraulic cylinder 48 is in a contraction state and the boom foot pin 40 is located on the insertion position, the hydraulic cylinder 48 is bent upward at a substantially right angle taking the connection pin 92 as center.

Further, although a cylinder bracket 93 is, as well as the case of the first embodiment, formed in a channel shape having a bottom surface part 93*a* and left and right side wall parts 93*b* (only one side wall part is shown in the figure), the cylinder bracket 93 is divided into a base end side bracket 94 fixed to the inner piece 36*a* of the bifurcated connection portion 36 and a front end side bracket 95. The front end side bracket 95 is rotatably connected to the base end side bracket 94 on an upper edge of the side wall parts 93*b* through a hinge member 96, removably connected to the base end side bracket 94 on the bottom surface part 93*a* by using a fastening member 97 such as bolts, and bent upward at a substantially right angle taking the hinge member 96 as center. It should be noted that other configurations of the boom foot pin attachment and detachment apparatus 90 are the same as the boom foot pin attachment and detachment apparatus 41 according to the first embodiment, and the same members are given the same reference numerals and explanation thereof will be omitted.

In the boom foot pin attachment and detachment apparatus 90, when the hydraulic cylinder 48 is in a contraction state and the boom foot pin 40 is located on the insertion position, not only the hydraulic cylinder 48 is bent upward at a substantially right angle but also the front end side bracket 95 of the cylinder bracket 93 is bent upward at a substantially right angle. Therefore, it is possible to ensure wider working space on the front side of the upper rotating body 2 at the time of the connection and removal works of the winch hose pipes 42 (refer to FIG. 2), and there is an effect of further contributing to the facilitation and the acceleration of the works.

It should be noted that the present invention is not limited to the first to third embodiments mentioned above, but includes a variety of other modes. For example in the first embodiment, one regulation plate 50 exercises the function as the first regulating means for preliminarily regulating the sliding of the slide plate 47 when the boom foot pin 40 is inserted into the pin holes 38 and 39 from the pull out position by the extending action of the hydraulic cylinder 48, and the function as the second regulating means for preliminarily regulating the movement of the boom foot pin 40 from the insertion position when the hydraulic cylinder 48 performs the contracting action after the boom foot pin 40 is inserted into the pin holes 38 and 39 by the extending action of the hydraulic cylinder 48. However, in the present invention, both the regulating means may be formed by separated plates or other members, or configured so as to automatically switch between the regulation and release thereof.

In the above embodiments, the description is given to the boom foot pin attachment and detachment apparatuses 41, 80 and 90 where the bifurcated connection portion 36 is formed on front end part of the frames 35*a* and 35*b* of the upper rotating body 2, the flat plate connection portion 37 inserted into the bifurcated connection portion 36 is formed on the boom foot 3*a*, the pin holes 38 and 39 are provided in both the connections portions 36 and 37 respectively, and in a state that both the pin holes 38 and 39 are aligned, the boom foot pin 40 is inserted into both the pin holes 38 and 39 so as to detachably connect the boom foot 3*a* with the upper rotating body 2. However, the present invention is not limited to the above, but also applied to a boom foot pin attachment and detachment apparatus where a bifurcated connection portion is formed on a boom foot, flat plate connection portion inserted into the bifurcated connection portion is formed on an upper rotating body, pin holes are provided in both the connection portions respectively, and in a state that both the pin holes are aligned, a boom foot pin is inserted into both the pin holes so as to detachably connect the boom foot with the upper rotating body.

Although the invention has been described with reference to the preferred embodiments in the attached figures, it is noted that equivalents may be employed and substitutions made herein without departing from the scope of the invention as recited in the claims.

I claim:

1. A boom foot pin attachment and detachment apparatus for construction machine, comprising:

a bifurcated connection portion being formed on one of an upper rotating body and a boom foot, a flat plate connection portion inserted into said bifurcated connection portion being formed on the other, pin holes being provided in both said connection portions respectively, in a state that both said pin holes are aligned a boom foot pin being inserted into both said pin holes so as to detachably connect the boom foot with the upper rotating body;

a cylinder bracket enabling said boom foot pin to move between an insertion position where said boom foot pin is inserted into said pin holes and a pull out position where said boom foot pin is pulled out from said pin holes, a base end of the cylinder bracket being attached to an inner piece of said bifurcated connection portion;

a slide plate slidably provided on said cylinder bracket along the moving direction of said boom foot pin;

a hydraulic cylinder, a cylinder main body thereof being attached to said slide plate and a piston rod thereof being connected to said boom foot pin;

first regulating means connectable at a first position on said cylinder bracket for preliminarily regulating sliding of said slide plate when said boom foot pin is inserted from the pull out position into said pin holes by an extending action of said hydraulic cylinder; and second regulating means connectable at a second position on said cylinder bracket for preliminarily regulating movement of said boom foot pin from the insertion position when said hydraulic cylinder performs a contracting action after said boom foot pin is inserted into said pin holes by the extending action of said hydraulic cylinder.

2. The boom foot pin attachment and detachment apparatus according to claim 1, wherein said first regulating means comprises a regulation plate selectively attached to first grooves at the first position on the front end side of said cylinder bracket, and the second regulating means comprises the regulation plate selectively attached to second grooves at the second position on the base end side of said cylinder bracket.

3. The boom foot pin attachment and detachment apparatus according to claim 1, wherein said cylinder bracket is formed in a channel shape having a bottom surface part and left and right side wall parts, and said slide plate is formed in a rectangular shape in correspondence with the channel shape of said cylinder bracket.

4. The boom foot pin attachment and detachment apparatus according to claim 3, wherein said piston rod of said hydraulic cylinder is connected to said boom foot pin through a connection plate, and the connection plate is formed in a rectangular shape in correspondence with the channel shape of said cylinder bracket.

5. The boom foot pin attachment and detachment apparatus according to claim 3, wherein said hydraulic cylinder is mounted to extend perpendicular to the boom foot pin when said hydraulic cylinder itself is in a contraction state and said boom foot pin is located in the insertion position.

6. The boom foot pin attachment and detachment apparatus according to claim 5, wherein said cylinder bracket is divided into a base end side bracket and a front end side bracket, and the front end side bracket is pivotally connected to the base end side bracket.

* * * * *